US006167869B1

(12) United States Patent
Martin et al.

(10) Patent No.: US 6,167,869 B1
(45) **Date of Patent: *Jan. 2, 2001**

(54) FUEL INJECTOR UTILIZING A MULTIPLE CURRENT LEVEL SOLENOID

(75) Inventors: David E. Martin, Normal; Glen F. Forck, Peoria; Dana R. Coldren, Fairbury; Marvin P. Schneider, East Peoria; Prabhakar Ramalingam, Normal, all of IL (US)

(73) Assignee: Caterpillar Inc., Peoria, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/963,275

(22) Filed: Nov. 3, 1997

(51) Int. Cl.[7] ..... F02M 37/04

(52) U.S. Cl. ..... 123/458; 123/467; 123/506; 137/628; 251/129.21

(58) Field of Search ..... 123/458, 467, 123/506, 501, 500; 137/630.15, 628, 630.19; 251/129.21, 129.08, 129.14

(56) References Cited

U.S. PATENT DOCUMENTS

| | | | | |
|---|---|---|---|---|
| 3,451,429 | | 6/1969 | Vick | 137/625.65 |
| 3,937,242 | | 2/1976 | Eckert | 137/102 |
| 4,002,318 | | 1/1977 | Koch | 251/129 |
| 4,407,245 | | 10/1983 | Eheim | 123/359 |
| 4,442,998 | | 4/1984 | Ohyama et al. | 251/129 |
| 4,583,509 | | 4/1986 | Schechter et al. | 123/451 |
| 4,597,369 | * | 7/1986 | Yasuhara | 123/458 |
| 4,602,309 | | 7/1986 | Gaude | 361/210 |
| 4,714,089 | | 12/1987 | Ueda et al. | 137/614.18 |
| 4,753,212 | * | 6/1988 | Miyaki | 123/458 |
| 4,785,787 | * | 11/1988 | Riszk | 123/458 |
| 4,832,312 | * | 5/1989 | Linder | 123/458 |
| 4,932,430 | | 6/1990 | Fernstrom | 137/85 |
| 4,971,290 | | 11/1990 | Dahlmann | 251/129.15 |
| 5,069,420 | | 12/1991 | Stobbs et al. | 251/30.02 |
| 5,104,046 | | 4/1992 | Sakagami | 239/585 |
| 5,178,359 | | 1/1993 | Stobbs et al. | 251/30.02 |
| 5,341,787 | * | 8/1994 | Zabeck | 123/458 |
| 5,433,385 | | 7/1995 | Sakagami et al. | 239/585.1 |
| 5,810,328 | * | 9/1998 | Boehland | 123/458 |
| 5,890,471 | * | 4/1999 | Nishimura | 123/467 |
| 5,893,350 | * | 4/1999 | Timms | 123/467 |

FOREIGN PATENT DOCUMENTS

| | | | |
|---|---|---|---|
| 1102329 | 2/1968 | (GB) | B60T 13/68 |

* cited by examiner

*Primary Examiner*—Carl S. Miller
(74) *Attorney, Agent, or Firm*—Marshall, O'Toole, Gerstein, Murray & Borun

(57) ABSTRACT

A fuel injector includes first and second valves and a solenoid including a solenoid coil and an armature assembly wherein the first and second valves are coupled to the armature assembly. A solenoid drive circuit is coupled to the solenoid coil and delivers a first current waveform portion to the solenoid coil at a first time to cause the armature assembly to operate the first valve without operating the second valve. A second current waveform portion different than the first current waveform portion is applied to the solenoid coil at a second time later than the first time to operate the second valve.

29 Claims, 5 Drawing Sheets

FUEL INJECTOR UTILIZING A MULTIPLE CURRENT LEVEL SOLENOID

TECHNICAL FIELD

The present invention relates generally to fuel injection apparatus, and more particularly to a fuel injector utilizing a solenoid as a control device.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause the fuel delivery to the associated engine cylinder.

The injector may include a valving mechanism comprising a spill valve and a direct operated check (DOC) valve wherein the former is operated to circulate fuel through the injector for cooling, to control injection pressure and to reduce the back pressure exerted by the injector plunger on the cam following injection. However, the need to separately control two valves leads to the requirement for two separate solenoids to control the valves. Besides adding to the overall cost of the injector, the need for two solenoids undesirably increases component count and undesirably increases the overall size of the injector and/or decreases the space available inside the injector for other components.

SUMMARY OF THE INVENTION

A fuel injector includes a single solenoid which is capable of operating a plurality of moveable elements, such as valves.

More particularly, in accordance with one aspect of the present invention, a fuel injector includes first and second valves, a solenoid including a solenoid coil and an armature assembly wherein the first and second valves are coupled to the armature assembly and a solenoid drive circuit coupled to the solenoid coil. The solenoid drive circuit delivers a first current waveform portion to the solenoid coil at a first time to cause the armature assembly to operate the first valve without operating the second valve. The drive circuit further delivers a second current waveform portion different from the first current waveform portion to the solenoid coil at a second time later than the first time to operate the second valve. Preferably, each of the first and second current waveform portions includes a pull-in current level and a holding current level. Also preferably, the first valve comprises a spill valve, and the second valve may comprise either a two-way valve or a three-way valve which controls fluid pressure delivered to a check.

Still further in accordance with the preferred embodiment, the armature assembly comprises a single armature member coupled to the first and second valves. Also, the armature assembly preferably comprises first and second armature members coupled to the first and second valves, respectively.

Still further in accordance with the preferred embodiment, the first and second valves are biased by first and second springs, respectively, wherein the first and second springs exert first and second biasing forces, respectively.

In accordance with a further aspect of the present invention, a fuel injector includes a solenoid having a single movable armature member and a solenoid coil and a solenoid driver circuit coupled to the solenoid coil. The driver circuit delivers a first current waveform portion to the solenoid coil at a first time to move the armature member to a first position and further delivers a second current waveform portion which may be different than the first current waveform portion to the solenoid coil at a second time later than the first time to move the armature member to a second position different than the first position.

In accordance with yet another aspect of the present invention, a method of controlling a fuel injector having first and second valves and a solenoid including a solenoid coil and an armature assembly wherein the first and second valves are coupled to the armature assembly comprises the steps of delivering a first current waveform portion to the solenoid coil at a first time to cause the armature assembly to close the first valve without closing the second valve and delivering a second current waveform portion which may be different from the first current waveform portion to the solenoid coil at a second time later than the first time to cause the armature assembly to close the second valve.

In accordance with a still further aspect of the present invention, a method of controlling a fuel injector having first and second moveable armatures controlled by a solenoid coil comprises the steps of delivering a first current waveform portion to the solenoid coil at a first time to move the first armature without substantially moving the second armature and delivering a second current waveform portion different than the first current waveform portion to the solenoid coil at a second time later than the first time to move the second armature.

The present invention utilizes a single solenoid to control a plurality of movable elements, leading to a desirable decrease in component count as well as other possible advantages.

BEST MODE FOR CARRYING OUT THE INVENTION

Figure 1:
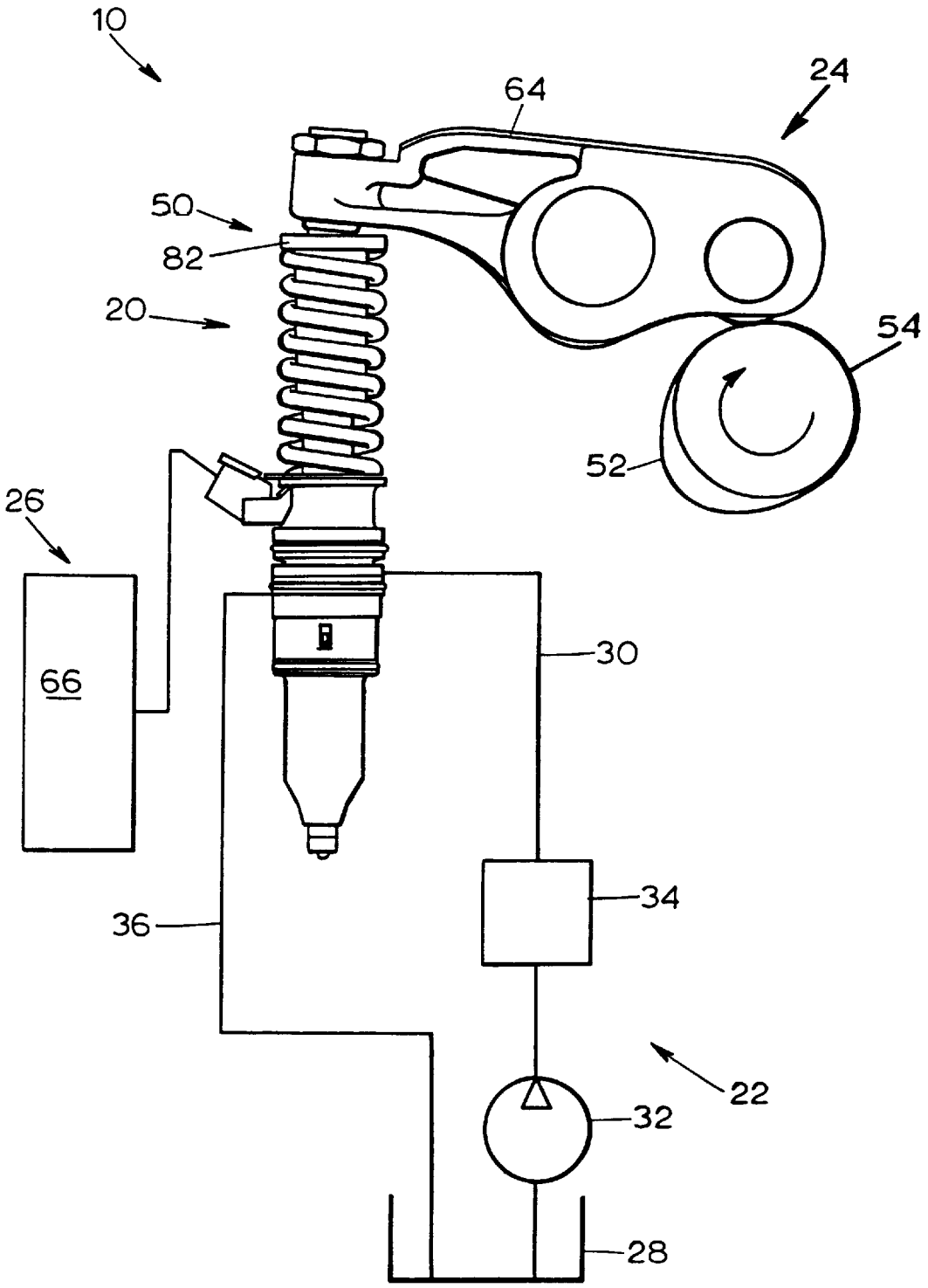
FIG. 1 is an elevational view of a fuel injector incorporating the present invention together with a cam shaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modifiedcycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically actuated device or hydraulically actuated device. In the embodiment shown a tappet and plunger assembly 50 associated with the injector 20 is mechanically actuated indirectly or directly by a cam lobe 52 of an engine-driven cam shaft 54. In the embodiment shown, the cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.)) and injecting the pressurized fuel into an associated cylinder. Although shown as a unitized injector 20, the injector could alternatively be of a modular construction wherein the fuel injection apparatus is separate from the fuel pressurization apparatus.

Figure 2:
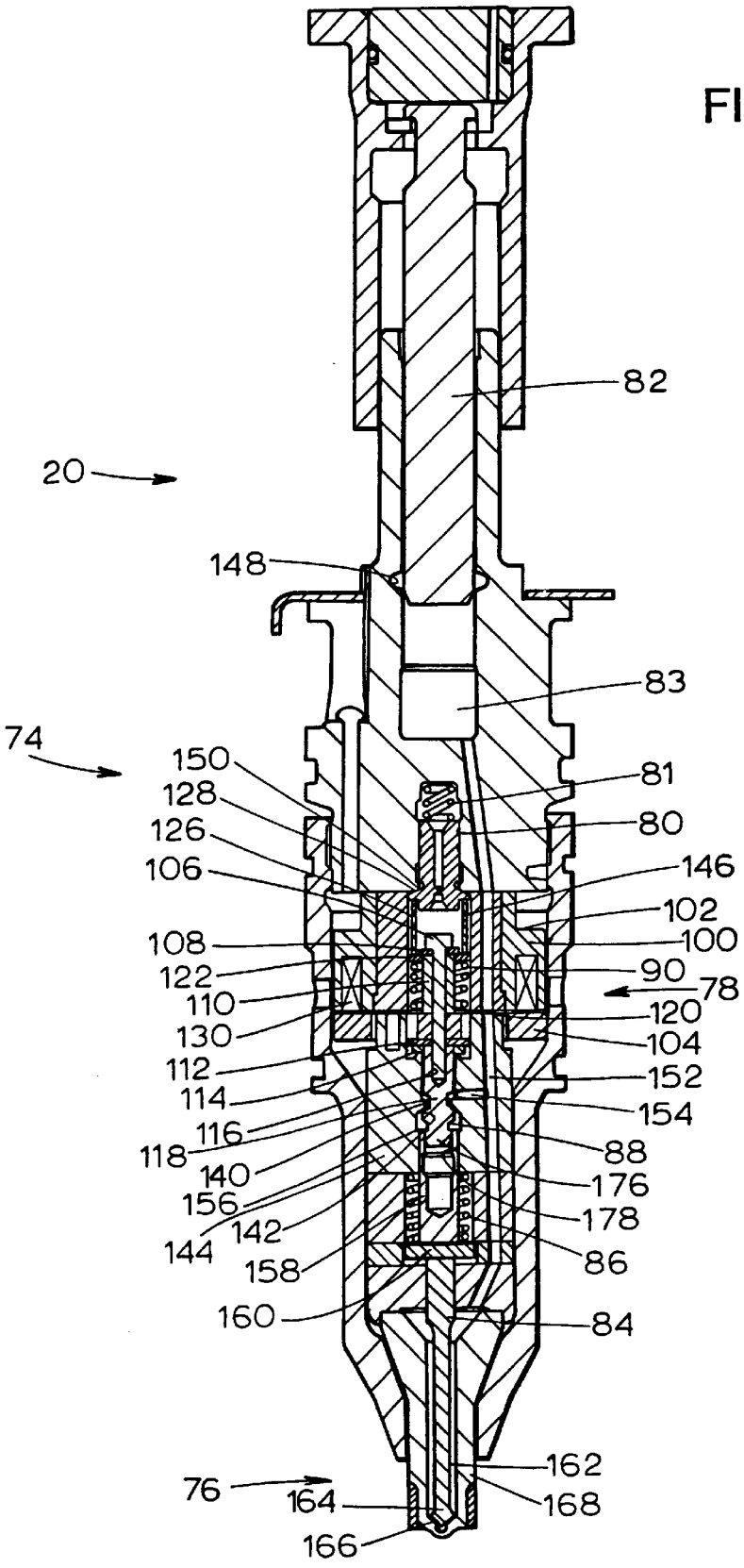
FIG. 2 is a sectional view of the fuel injector of FIG.
Figure 3:
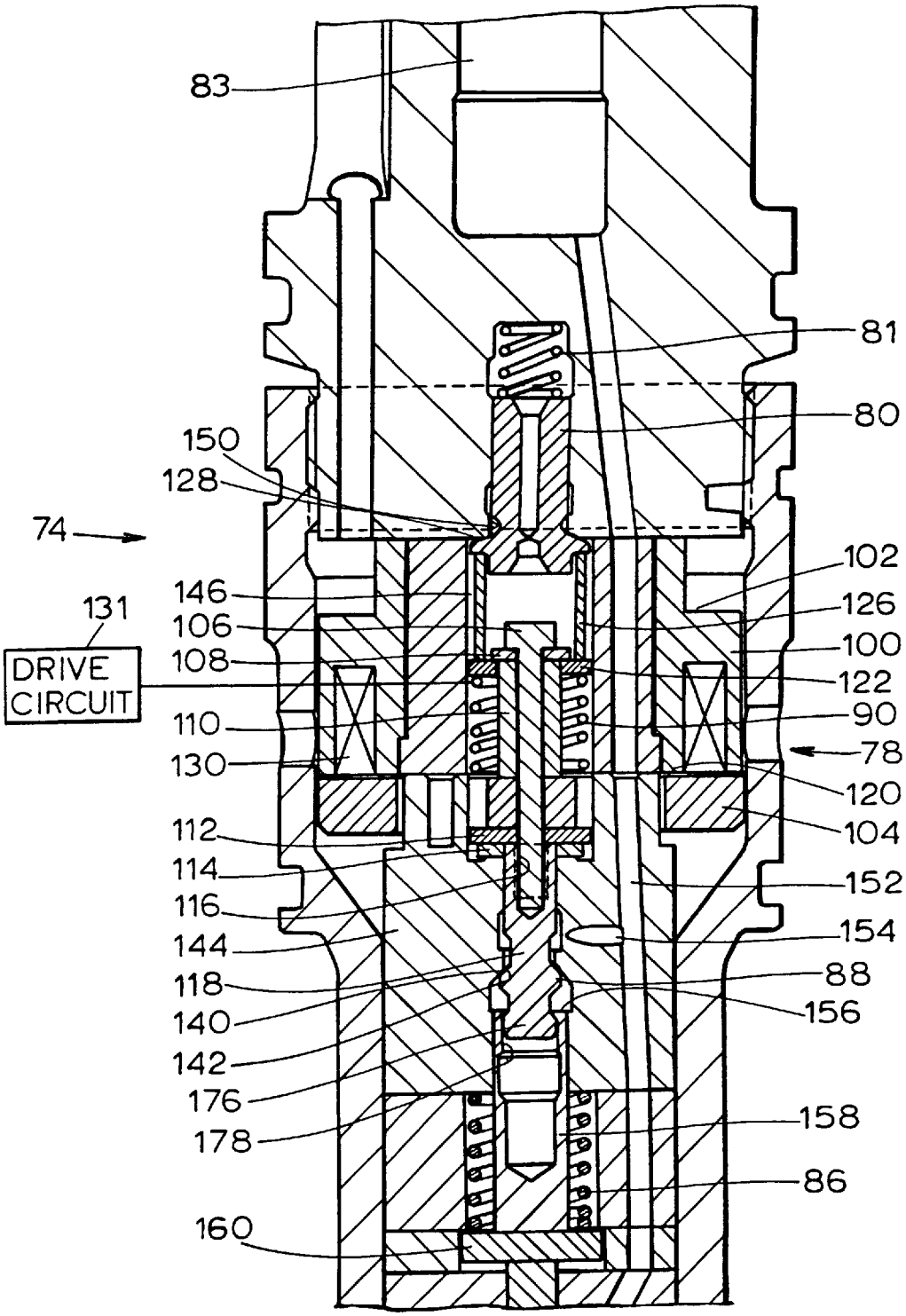
FIG. 3 is an enlarged, fragmentary sectional view of the fuel injector of FIG. 2 illustrating the solenoid, high pressure spill valve and DOC valve in greater detail.

Referring now to FIGS. 2 and 3, the injector 20 includes a housing 74, a nozzle portion 76, an electrical actuator 78, a high pressure spill valve 80, a spill valve spring 81, a plunger 82 disposed in a plunger cavity 83, a check 84, a check spring 86, a two-way direct operated check (DOC) valve 88 and a DOC spring 90. In the preferred embodiment, the spill valve spring 81 exerts a first spring force when compressed whereas the DOC spring 90 exerts a second spring force greater than the first spring force when compressed.

The electrical actuator 78 comprises a solenoid 100 having a stator 102 and an armature assembly in the form of a single armature 104. A bolt 106 and a washer 108 bear against a cylindrical member 110 which in turn bear against the armature 104. The bolt 106 further extends through a pair of additional washers 112, 114 into a threaded bore 116 in a valve stem or poppet 118 of the DOC valve 88. (The washer 114 also surrounds the poppet 118.)

The DOC spring 90 is placed in compression between a surface 120 of the armature 104 and a DOC spring preload spacer 122 which abuts the washer 108. A cylindrical spill valve spacer 126 is disposed between the spacer 122 and a shouldered portion 128 of the spill valve 80. The DOC spring preload spacer 122 is axially slidable over the cylindrical member 110, for reasons explained hereinafter.

Prior to the time that injection is to occur, a solenoid coil 130 disposed in the solenoid stator 102 and coupled to a drive circuit 131 is unenergized. Accordingly, the armature 104 is not attracted to the solenoid stator 102, thereby permitting the spill valve spring 81 to open the spill valve 80. Fuel circulates from the transfer pump and the fuel supply passage 30 into internal passages (not shown) of the fuel injector 20 which connect with a space 146 below the shouldered portion 128. The fuel passes through the open spill valve 80 into a space 150 above the spill valve 80 and thence through one or more further passages (not shown) to the plunger cavity 83. When the plunger 82 is in the full upward position, passages (also not shown) in the plunger 82 conduct the fuel to an annular recess 148 surrounding the plunger 82, which is in turn coupled in fluid communication with the drain passage 36. The fuel thus recirculates through the injector 20 during non-injection portions of each engine cycle for the purpose of cooling and to fill the plunger chamber.

Also at this time, the DOC valve poppet 118 is disposed in an open position at which a sealing surface 140 of the valve poppet 118 is spaced from a valve seat 142 defined by a DOC body 144.

Industrial Applicability

Figure 4:
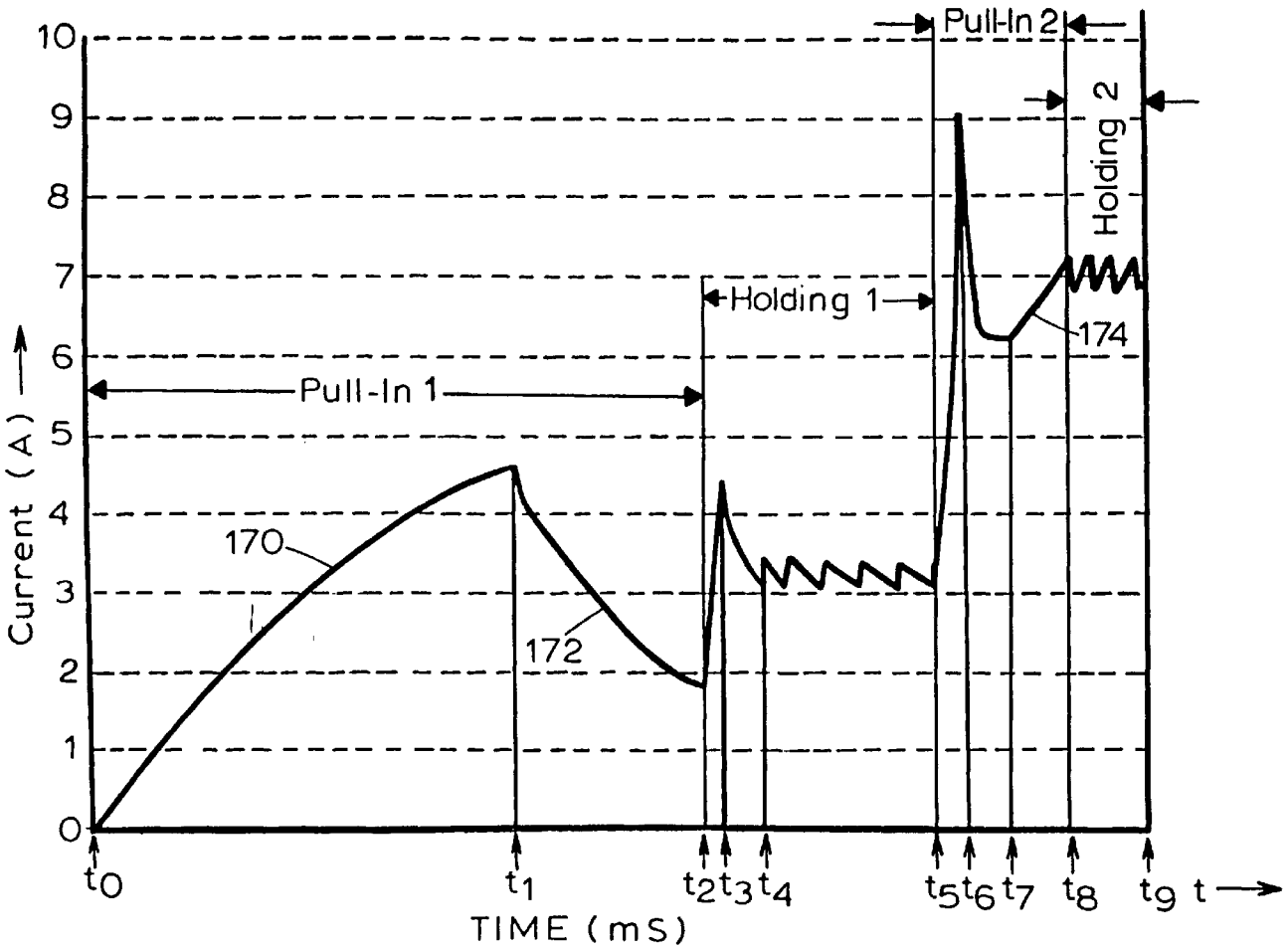
FIG. 4 is a waveform diagram illustrating current waveforms supplied to the solenoid coil of FIGS. 2 and 3.

FIG. 4 illustrates a current waveform 170 applied by the drive circuit 131 to the solenoid coil 130 during a portion of an injection sequence to accomplish fuel injection. The current waveform includes a first current waveform portion 172 extending between times $t=t_0$, and $t=t_5$ and a second current waveform portion 174 occurring subsequent to the time $t=t_5$. Between time $t=t_0$ and time $t=t_2$, a first pull-in current is provided to the solenoid coil 130 to move the armature 104 a first distance toward the solenoid stator 102. A first holding current at somewhat reduced levels is thereafter applied between times $t=t_2$ and $t=t_5$. The magnitudes of the first pull-in current and the first holding current are selected so that the magnetic forces developed thereby on the armature 104 exceed the first spring force exerted by the spill valve spring 81 but are less than the second spring force exerted by the DOC valve spring 90. The motive force developed by the armature 104 is transmitted through the DOC spring 90, the DOC spring preload spacer 122 and the spill valve spacer 126 to close the spill valve 80. Movement of the spill valve 80 is damped by fluid flowing through a damping orifice 175. The force developed by the armature 104 during this interval is insufficient to substantially compress the DOC spring 90. Further during this interval, the valve poppet 118 moves upwardly with the armature 104; however, the amount of this travel from the fully opened position of the valve poppet 118 is insufficient to cause the sealing surface 140 to contact the seat 142, and hence the DOC valve 88 remains open.

Subsequently, fuel is pressurized by downward movement of the plunger 82 in the plunger cavity 83. The pressurized fuel is conducted through a high pressure fuel passage 152 and a cross passage 154 past the sealing surface 140 and the seat 142 to an upper surface 156 of a DOC piston 158. The DOC piston 158 in turn bears against a spacer 160 which abuts a top end of the check 84. The fuel passage 152 further conducts pressurized fluid to a check passage 162. Accordingly, the fluid pressures across the check 84 are substantially balanced and hence the spring 86 moves the check to the closed position such that a check tip 164 bears against a seat 166 of a tip member 168.

Thereafter, subsequent to the time $t_5$, the second current waveform portion 174 is applied to the solenoid coil 130. Following a second pull-in current magnitude, a second holding current is supplied to the coil 130. The second pull-in current and the second holding current in general may be greater in magnitude than the first pull-in current and the first holding current, respectively. In response to application of this current waveform portion, the armature 104 moves the valve poppet 118 against the force of the DOC spring 90, thereby causing the sealing surface 140 to contact the seat 142. During such movement, the cylindrical member 110 moves axially upward within the DOC spring preload spacer 122 so that an overtravel characteristic is obtained. Fluid captured in the space above the upper surface 156 of the DOC piston 158 bleeds via a controlled leakage path between a head portion 176 of the valve poppet 118 and a wall 178 of the DOC piston 158 and through a passage (not shown) extending through the side walls of the DOC piston 158 to drain. A low fluid pressure zone is thereby established above the DOC piston 158 thereby causing the check 84 to move upwardly and initiate fuel injection. It should be noted that this controlled leakage path is sufficiently small to maintain a high fluid pressure condition when the DOC valve 88 is open but is large enough to quickly bleed off the high pressure fluid when the DOC valve 88 is closed.

When injection is to be terminated, the current supplied to the solenoid 130 may be reduced to the holding level of the current waveform 172 as illustrated in FIG. 4. If desired, the current delivered to the solenoid coil 130 may instead be reduced to zero or any other level less than the first holding level. In any case, the magnetic attractive force on the armature 104 is thus reduced, permitting the DOC spring 90 initially to move the valve poppet 118 downwardly to the open position whereby fluid communication is again established between the fuel passage 152 and the space above the upper surface 156 of the DOC piston 158. The application of high fuel pressure to the top of the DOC piston 158 and the force exerted by the spring 86 cause the check 84 to move downwardly such that the check tip 164 engages the seat 166, thereby preventing further fuel injection. Subsequently, the current supplied to the solenoid coil 130 may be reduced to zero or any other level less than the first holding level (if it has not already been so reduced). Regardless of whether the applied current level is immediately dropped to the first holding level or to a level less than the first holding level, the spill valve spring 81 opens the spill valve 80 after the DOC spring 90 moves the valve poppet 118 downwardly. Fuel then circulates through the spill valve 80, the spaces 146 and 150, the plunger cavity 83, the passages in the plunger 82 and the annular recess 148 to drain for cooling purposes as described above.

Still further, multiple or split injections per injection cycle can be accomplished by supplying suitable waveform portions to the solenoid coil 130. For example, the first and second waveform portions 172, 174 may be supplied to the coil 130 to accomplish a pilot or first injection. Immediately thereafter, the current may be reduced to the first holding current level and then increased again to the second pull-in and second holding levels to accomplish a second or main injection. Alternatively, the pilot and main injections may be accomplished by initially applying the waveform portions 172 and 174 to the solenoid coil 130 and then repeating application of the portions 172 and 174 to the coil 130. The durations of the pilot and main injections (and hence, the quantity of fuel delivered during each injection) are determined by the durations of the second holding levels in the waveform portions 174. Of course, the waveform shapes shown in FIG. 4 may be otherwise varied as necessary or desirable to obtain a suitable injection response or other characteristic.

As should be evident from the foregoing, the drive circuit 131 is capable of moving the armature 104 to first and second positions as a result of the application of first and second waveform portions, respectively, to the solenoid coil 130. Movement to the first position closes the spill valve 80 whereas movement to the second position closes the DOC valve 88. Because only a single solenoid is needed to operate the two valves 80, 88, as opposed to two solenoids to accomplish this function, size and weight can be reduced.

Figure 5:
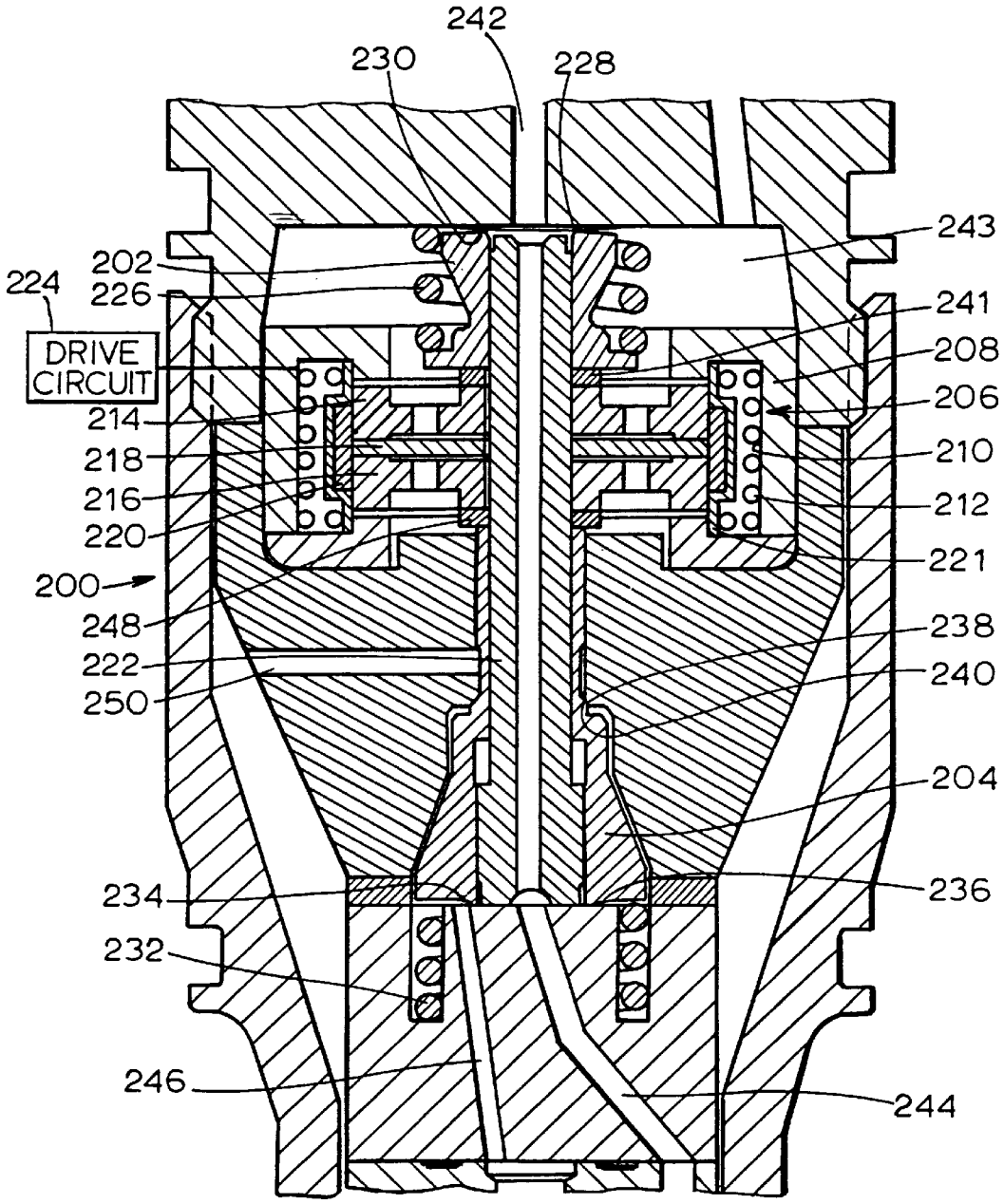
FIG. 5 is a fragmentary sectional view of an alternative fuel injector incorporating the present invention.

While the present invention can be utilized in connection with a solenoid having a single armature, it should be noted that a solenoid having more than one armature may alternatively be used. For example, FIG. 5 illustrates a portion of a fuel injector 200 having a first valve 202, a second, three-way valve 204 and a solenoid 206 for controlling the first and second valves 202, 204. The solenoid 206 includes a stator 208 having a recess 210 within which is disposed a solenoid coil 212. The solenoid 206 further includes an armature assembly comprising first and second annular armatures 214, 216, respectively, which are disposed on either side of an annular central spacer member fabricated of nonmagnetic (i.e., high reluctance) material 218. The central spacer member 218 is secured to a cylindrical outboard flux conduction member 220 which is molded into a coil bobbin 221 retained within the stator 208. The first and second armatures 214, 216 surround a central tube 222, as do the first and second valves 202, 204 and the central spacer member 218.

As in the previous embodiment, the solenoid coil 212 receives the current waveform portions 172, 174 of FIG. 4 from a drive circuit 224.

Initially during an injection sequence, the solenoid coil 212 is unenergized, thereby permitting a first valve spring 226 (which exerts a first spring force) to open the first valve 202 such that a sealing surface 228 is spaced from a valve seat 230. Also at this time, a second valve spring 232 (which exerts a second spring force greater than the first spring force) moves the second valve 204 upwardly to a position whereby a sealing surface 234 is spaced from a valve seat 236 and such that a further sealing surface 238 is in sealing contact with a further valve seat 240. Under these conditions, fuel flowing through a passage 242 enters a space 243 and thereafter flows to drain through a further passage (not shown). Subsequently, the lobe on the cam pushes down on a plunger (not shown) of the injector 200 and pressurizes the fuel in the passage 242, thereby effectively metering the amount of fuel in the injector. The current waveform portion 172 is then delivered to the solenoid coil 212 by the drive circuit 224. The pull-in and holding current levels of the portion 172 and the first and second valve springs 226, 232 are selected such that the motive force developed by the first armature 214 exceeds the first spring force but the motive force developed by the second armature 216 is less than the second spring force. Consequently the first armature 214 moves upwardly against a spacer 241 and closes the first valve 202. At this point, the sealing surface 228 is moved into sealing contact with the seat 230, thereby shutting off the path to drain for the fluid in the passage 242. Also during this time, because the second valve spring 232 exerts a greater spring force than the force developed by the second armature 216, the second valve 204 remains open in the previously described condition. Pressurized fluid is thereby delivered to first and second check end passages 244, 246 leading to bottom and top ends of a check assembly (not shown). Because the fluid pressures on the ends of the check assembly are substantially balanced, the check remains closed at this time.

The drive circuit 224 thereafter delivers the second current waveform portion 174 to the solenoid coil 212. This increased current level develops an increased force on the second armature 216 which exceeds the second spring force, causing such armature to move downwardly. This downward movement is transmitted by a spacer 248 to the valve 204 to cause the valve 204 also to move downwardly such that the sealing surface 234 is moved into sealing contact with the valve seat 236. In addition, the sealing surface 238 moves out of sealing contact with the further valve seat 240. The effect of this movement is to isolate the second check end passage 246 from the high pressure fluid in the passage 242 and to permit fluid communication between the second check end passage 246 and a drain passage 250. The pressures across the check assembly then become unbalanced, thereby overcoming the check spring force and driving the check upwardly and permitting fuel to be injected into an associated cylinder.

When injection is to be terminated, the current delivered to the solenoid coil 212 is reduced to the holding level of the first current waveform portion 172 as illustrated in FIG. 4 to move the second valve 204 upwardly, thereby reconnecting the second check end passage 246 to the passage 242. The fluid pressures across the check thus become balanced, thereby allowing a check spring and fluid forces to close the check. The current may then be reduced to zero, allowing the first valve spring 226 to open the first valve 202.

If desired, the solenoid coil may receive more than two current waveform portions to cause either a single armature or multiple armatures to move to any number of positions (not just two), and thereby operate one or more valves or other movable elements. Split or multiple injections can be obtained by application of proper current waveforms, as explained in connection with the previous embodiment.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

What is claimed is:

1. A fuel injector, comprising:

first and second valves;

a solenoid including a solenoid coil and an armature assembly having an aperture extending fully therethrough, wherein the armature assembly is disposed between the first and second valves and wherein a portion of one of the first and second valves passes through the aperture and is coupled to the armature assembly; and a solenoid drive circuit coupled to the solenoid coil and delivering a first current waveform portion to the solenoid coil at a first time to cause the armature assembly to operate the first valve without operating the second valve and delivering a second current waveform portion different than the first current waveform portion to the solenoid coil at a second time later than the first time to operate the second valve.

2. The fuel injector of claim 1, wherein each of the first and second current waveform portions includes a pull-in current level and a holding current level.

3. The fuel injector of claim 1, wherein the first valve comprises a spill valve.

4. The fuel injector of claim 1, further including a check which is movable to an open position and wherein the second valve comprises a two-way valve which controls fluid pressure delivered to the check.

5. The fuel injector of claim 1, further including a check which is movable to an open position and wherein the second valve comprises a three-way valve which controls fluid pressure delivered to the check.

6. The fuel injector of claim 1, wherein the armature assembly comprises a single armature member coupled to the first and second valves.

7. The fuel injector of claim 1, wherein the armature assembly comprises first and second armature members coupled to the first and second valves, respectively.

8. The fuel injector of claim 1, wherein the first and second valves are biased by first and second springs, respectively, and wherein the first and second springs exert first and second biasing forces, respectively.

9. A fuel injector having first and second valves, comprising:

a solenoid including a movable armature member having an aperture extending fully therethrough and a solenoid coil, wherein the movable armature member is disposed between the first and second valves so that a portion of one of the first and second valves passes through the aperture; and a solenoid driver circuit coupled to the solenoid coil and delivering a first current waveform portion to the solenoid coil at a first time to move the armature member to a first position and delivering a second current waveform portion different than the first current waveform portion to the solenoid coil at a second time later than the first time to move the armature member to a second position different than the first position.

10. The fuel injector of claim 9, wherein each of the first and second current waveform portions includes a pull-in current level and a holding current level.

11. The fuel injector of claim 10, further including a check which is movable to an open position and wherein the second valve comprises a two-way valve which controls fluid pressure delivered to the check.

12. The fuel injector of claim 11, further including a spill valve and a two-way valve coupled to the armature member.

13. The fuel injector of claim 9, further including a spill valve and a three-way valve coupled to the armature member.

14. The fuel injector of claim 13, wherein the spill valve and the three-way valve are biased by first and second springs, respectively, and wherein the first and second springs exert first and second biasing forces, respectively.

15. A method of controlling a fuel injector having first and second valves and a solenoid including a solenoid coil and an armature assembly having an aperture extending fully therethrouqh, wherein the armature assembly is disposed between the first and second valves and wherein a portion of one of the first and second valves [are] passes through the aperture and is coupled to the armature assembly, the method comprising the steps of:

delivering a first current waveform portion to the solenoid coil at a first time to cause the armature assembly to close the first valve without closing the second valve; and delivering a second current waveform portion different than the first current waveform portion to the solenoid coil at a second time later than the first time to cause the armature assembly to close the second valve.

16. The method of claim 15, wherein each step of delivering comprises the step of providing a pull-in current and a holding current to the solenoid coil.

17. The method of claim 15, wherein the first valve comprises a spill valve.

18. The method of claim 15, wherein the fuel injector includes a check which is movable to an open position and wherein the second valve comprises a two-way valve which controls fluid pressure delivered to the check.

19. The method of claim 15, wherein the fuel injector includes a check which is movable to an open position and wherein the second valve comprises a three-way valve which controls fluid pressure delivered to the check.

20. The method of claim 15, wherein the armature assembly comprises a single armature member coupled to the first and second valves.

21. The method of claim 15, wherein the armature assembly comprises first and second armature members coupled to the first and second valves, respectively.

22. The method of claim 15, wherein the first and second valves are biased by first and second springs, respectively, and wherein the first and second springs exert first and second biasing forces, respectively.

23. A method of controlling a fuel injector having first and second valves and first and second movable armatures controlled by a solenoid coil and disposed between the first and second valves so that a portion of one of the first and second valves passes through an aperture that extends fully through one of the movable armatures, the method comprising the steps of:

delivering a first current waveform portion to the solenoid coil at a first time to move the first armature without substantially moving the second armature; and delivering a second current waveform portion different than the first current waveform portion to the solenoid coil at a second time later than the first time to move the second armature.

24. The method of claim 23, wherein the step of delivering comprises the step of providing a pull-in current and a holding current to the solenoid coil.

25. The method of claim 24, wherein the first armature is coupled to a spill valve.

26. The method of claim 25, wherein the fuel injector includes a check which is movable to an open position and wherein the second armature is coupled to a two-way valve which controls fluid pressure delivered to the check.

27. The method of claim 26, wherein the spill valve and the two-way valve are biased by first and second springs, respectively, and wherein the first and second springs exert first and second biasing forces, respectively.

28. The method of claim 25, wherein the fuel injector includes a check which is movable to an open position and wherein the second armature is coupled to a three-way valve which controls fluid pressure delivered to the check.

29. The method of claim 28, wherein the spill valve and the three-way valve are biased by first and second springs, respectively, and wherein the first and second springs exert first and second biasing forces, respectively.

* * * * *